US008144117B2

(12) United States Patent
Okada et al.

(10) Patent No.: US 8,144,117 B2
(45) Date of Patent: Mar. 27, 2012

(54) IMAGE DISPLAY DEVICE AND CONTROL METHOD THEREOF

(75) Inventors: Atsushi Okada, Kanagawa (JP); Masahiro Yanagisawa, Kanagawa (JP); Yoshihisa Naijo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 734 days.

(21) Appl. No.: 12/259,558

(22) Filed: Oct. 28, 2008

(65) Prior Publication Data

US 2009/0109145 A1 Apr. 30, 2009

(30) Foreign Application Priority Data

Oct. 31, 2007 (JP) ..... 2007-283334

(51) Int. Cl.
*G09G 3/34* (2006.01)
*G09G 5/00* (2006.01)

(52) U.S. Cl. ..... 345/107; 345/98; 345/204

(58) Field of Classification Search ..... 345/31, 345/61, 107, 98, 204
See application file for complete search history.

(56) References Cited

U.S. PATENT DOCUMENTS

| | | | | |
|---|---|---|---|---|
| 6,636,186 | B1 * | 10/2003 | Yamaguchi et al. | 345/31 |
| 7,123,247 | B2 * | 10/2006 | Morita | 345/204 |
| 7,583,240 | B2 * | 9/2009 | Yamashita et al. | 345/60 |
| 2006/0244714 | A1 * | 11/2006 | Zhou et al. | 345/107 |
| 2007/0085837 | A1 * | 4/2007 | Ricks et al. | 345/173 |
| 2008/0048968 | A1 | 2/2008 | Okada et al. | |

FOREIGN PATENT DOCUMENTS

| | | |
|---|---|---|
| JP | 2004-258125 | 9/2004 |
| JP | 2007-33710 | 2/2007 |
| JP | 2007-507740 | 3/2007 |
| WO | WO 2005/034076 A1 | 4/2005 |

* cited by examiner

*Primary Examiner* — Quan-Zhen Wang
*Assistant Examiner* — Michael J Eurice
(74) *Attorney, Agent, or Firm* — Oblon, Spivak, McClelland, Maier & Neustadt, L.L.P.

(57) ABSTRACT

When not receiving the next display-switch starting signal even after a specified time elapses from the application of a previous display driving voltage, a driving unit applies another preparatory driving voltage for generating a preparatory electric field capable of improving the response of colored particles to a driving electric field to an extent so as not to change the arrangement of the colored particles between pixel electrodes and a transparent electrode for a preparatory driving time.

16 Claims, 12 Drawing Sheets

IMAGE DISPLAY DEVICE AND CONTROL METHOD THEREOF

BACKGROUND OF THE INVENTION

1. Field of the Invention

The present invention relates to image display devices such as electronic paper, flexible display devices, electronic books, and portable display devices in which electrophoretic particles are moved by the action of a driving electric field to change the display statuses of plural display pixels constituting a display image. The present invention also relates to a control method of the image display devices.

2. Description of the Related Art

Patent Document 1 discloses an image display device that encapsulates charged particles (electrophoretic particles) between a transparent display substrate and a rear-surface substrate and is capable of switching display images by separately moving the charged particles for each display pixel. In this image display device, a display driving voltage applied to each of the display pixels between the substrates is separately controlled. Accordingly, a driving electric field acting on the charged particles is changed to move the charged particles. Here, as the charged particles repeatedly perform image display, in particular, when the driving electric field continuously acts in one direction for a long period of time, the charged particles encapsulated between the substrates gradually aggregate with each other or the adhesion of the charged particles to the inner wall of a wall surface member encapsulating the charged particles gradually becomes strong. Accordingly, when the charged particles aggregate with each other or the adhesion of the charged particles becomes strong like this, the response to the driving electric field is degraded.

FIG. 1 is a graph showing results obtained by changing time (interval) until a display driving voltage is applied, so as to observe the reflectivity of a display image due to charged particles. The reflectivity under a 15-minute interval becomes lower than that under a 5-minute interval. This is mainly because the response of the charged particles to the driving electric field generated by the display driving voltage is degraded as the charged particles aggregate with each other or the adhesion of the charged particles to the inner wall becomes strong. It is found that the longer the interval is, the poorer the response of the charged particles to the driving electric field becomes.

In order to deal with this problem, the image display device of Patent Document 1 applies, before applying the display driving voltage to each of the display pixels, a preparatory driving voltage so as to generate an electric field that enables the movement of the charged particles. Accordingly, after making the charged particles easily move with the preparatory driving voltage, the image display device switches display images with the display driving voltage. As a result, even if the charged particles somewhat aggregate with each other or the adhesion of the charged particles to the inner wall becomes somewhat strong, the aggregation of the charged particles is eliminated by the preparatory driving voltage. Accordingly, the response of the charged particles to the driving electric field generated by the display driving voltage subsequently applied is improved.

Generally, when the response of the charged particles to the driving electric field is thus improved, the number of charged particles, which do not behave in accordance with the driving electric field, can be reduced. Accordingly, it is possible to properly and stably perform the display switch of an image. In addition, when the response of the charged particles to the driving electric field is improved, time required for completing the movement of the charged particles can be reduced. Accordingly, time until the display switch of an image is completed after the application of a display driving voltage can be reduced, which in turn makes it possible to perform the display switch at high speed.

Patent Document 1: JP-A-2007-33710

The image display device of Patent Document 1 can properly and stably perform the display switch of an image by improving the response of the charged particles to the driving electric field. However, it cannot perform the display switch at high speed.

Specifically, the image display device first receives a display driving instruction from the user through a switching operation for the display switch of an image and then applies the preparatory driving voltage and the display driving voltage. Accordingly, the image display device is required to ensure the time for applying the preparatory driving voltage until the time it applies the display driving voltage after receiving the display driving instruction. Therefore, even if the response of the charged particles to the driving electric field is improved by the preparatory driving voltage, the time required for applying the preparatory driving voltage is longer than the time reduced according to the improvement in the response. Thus, the display switch time until the display switch of the image is completed after the image display device applies the display driving voltage after receiving the display driving instruction becomes long. As a result, the image display device cannot perform the display switch at high speed.

SUMMARY OF THE INVENTION

The present invention has been made in view of the above problems and may provide an image display device capable of properly and stably performing the display switch of an image and improving the response of electrophoretic particles to a driving electric field to enable the display switch at high speed. The present invention may also provide a control method of the image display device.

According to one aspect of the present invention, an image display device is provided that includes a display unit that has electrophoretic particles between a rear-surface electrode on a rear-surface substrate and a transparent electrode on a transparent substrate provided for each of plural display pixels constituting a display image and that generates a driving electric field for moving the electrophoretic particles to the rear-surface electrode or the transparent electrode between the rear-surface electrode and the transparent electrode for each of the plural display pixels, a display status of each of the plural display pixels being changed when the electrophoretic particles are moved; and a driving unit that applies, after receiving a display driving instruction, a display driving voltage for controlling the driving electric field of each of the plural display pixels to at least one of the rear-surface electrode and the transparent electrode for each of the display pixels, an arrangement of the electrophoretic particles corresponding to the display driving voltage being maintained even after the driving unit completes the application of the display driving voltage, which results in maintaining the display status of the display image. When not applying a next display driving voltage even after a predetermined time elapses from starting or completion of applying a previous display driving voltage, the driving unit applies, to at least one of the rear-surface electrode and the transparent electrode, a preparatory driving voltage for generating a preparatory electric field capable of improving a response of the electrophoretic particles to the driving electric field to an extent so as not to change the arrangement of the electrophoretic particles for a predetermined preparatory driving time.

Other objects, features and advantages of the present invention will become more apparent from the following detailed description when read in conjunction with the accompanying drawings.

DETAILED DESCRIPTION OF THE PREFERRED EMBODIMENTS (First Embodiment)

A description is made of an embodiment (hereinafter referred to as a "first embodiment") in which the present invention is applied to electronic paper as an image display device.

Figure 1:
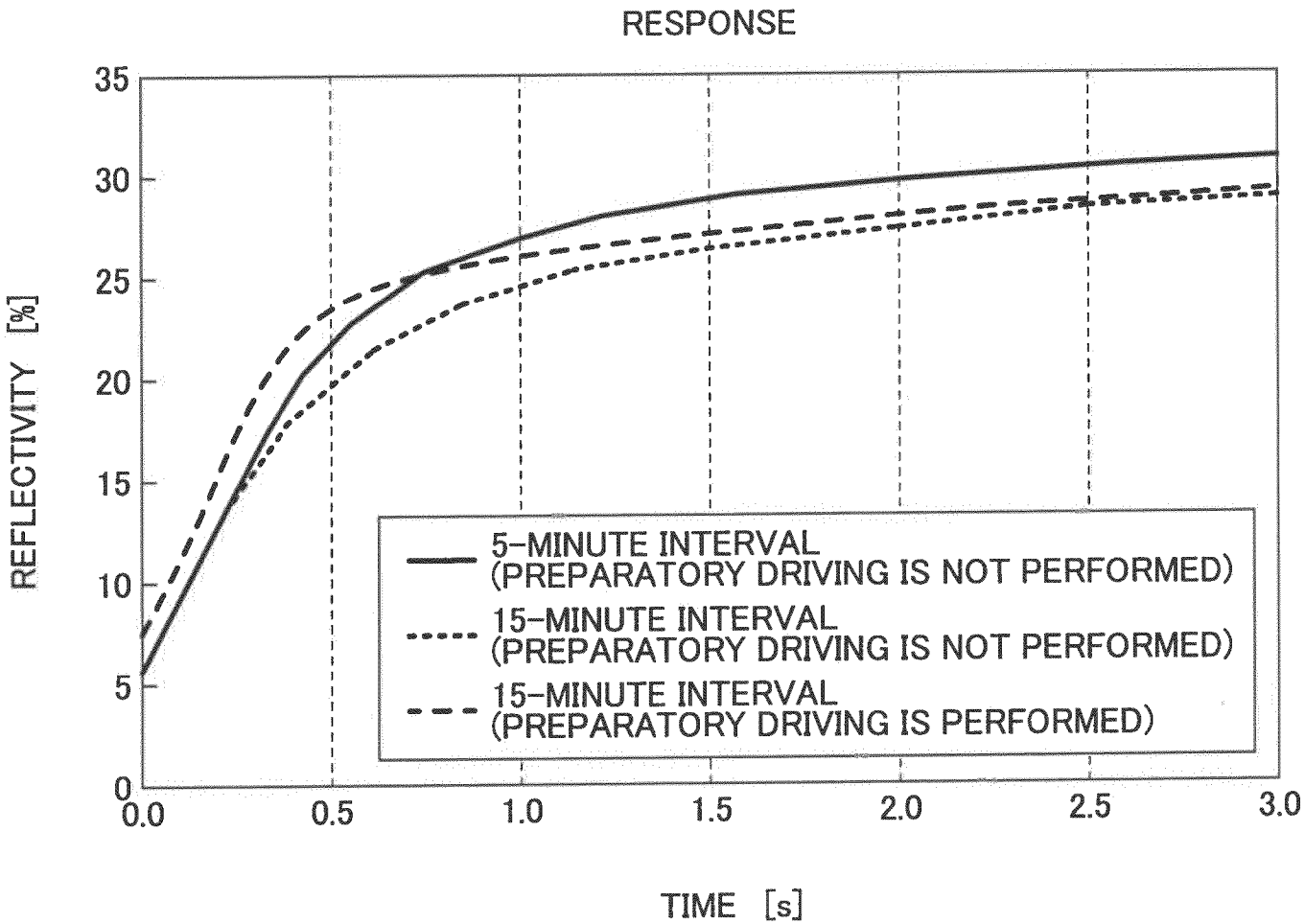
FIG. 1 is a graph showing results obtained by changing time (interval) until a display driving voltage is applied, so as to observe the reflectivity of a display image due to charged particles.
Figure 2:
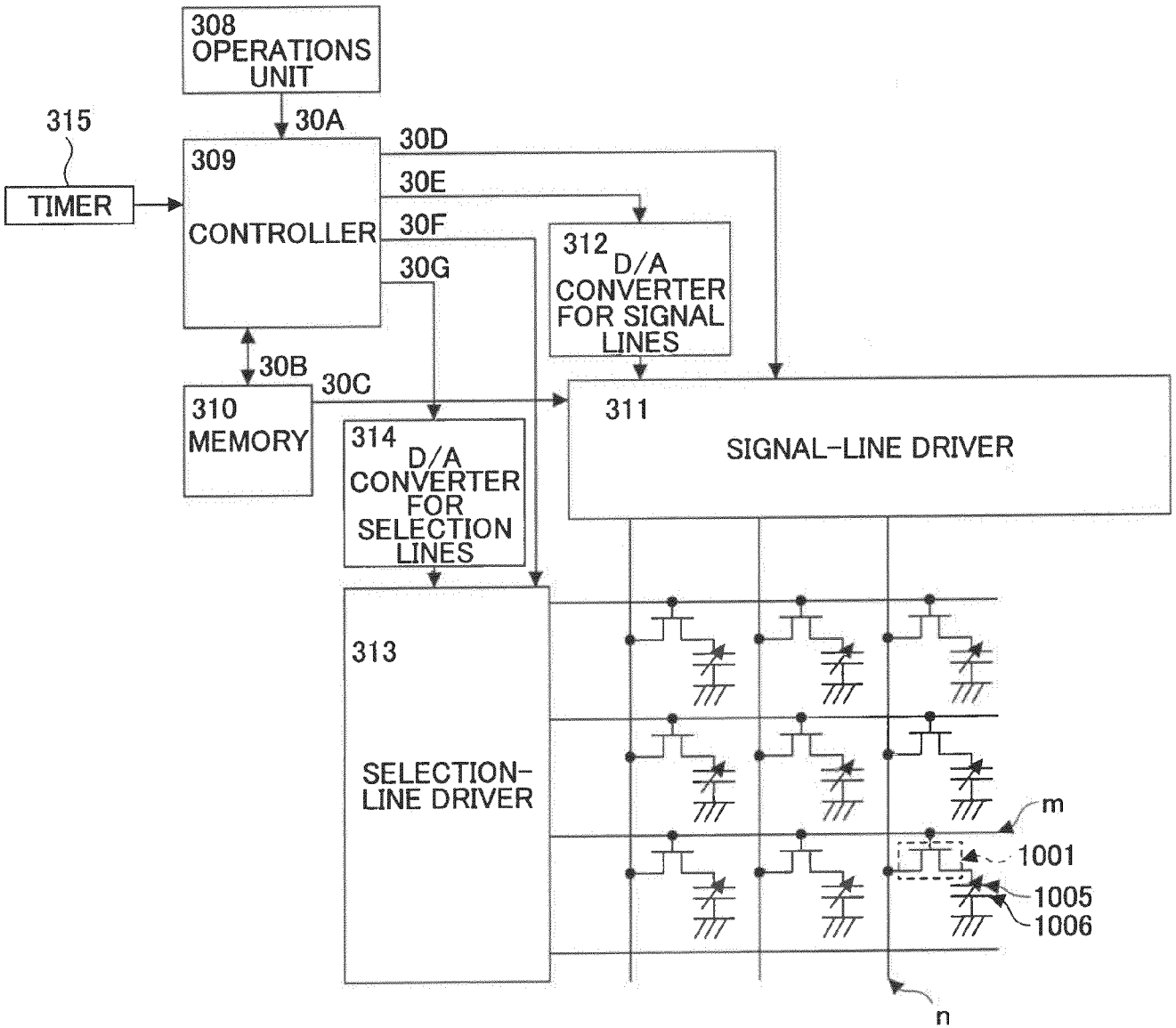
FIG. 2 is a block diagram showing a schematic configuration of a driving unit that performs the display control of a display unit of electronic paper according to a first embodiment.

FIG. 2 is a block diagram showing a schematic configuration of a driving unit that performs the display control of a display unit of the electronic paper.

Figure 3:
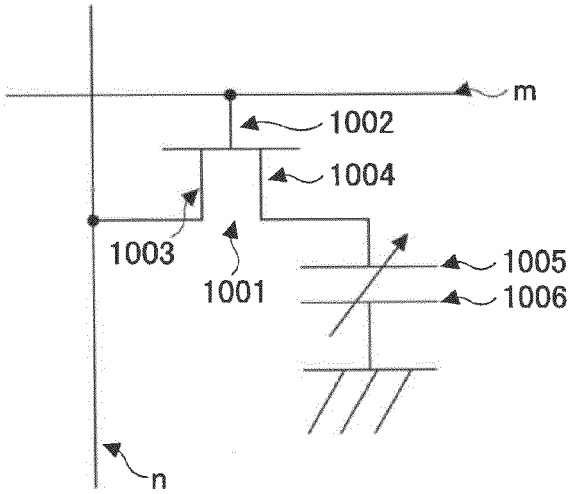
FIG. 3 is a schematic view of an enlarged part (by an amount of one display pixel) of an active matrix circuit constituting the driving unit.

FIG. 3 is a schematic view of an enlarged part (by an amount of one display pixel) of an active matrix circuit constituting the driving unit.

In FIG. 3, a signal line extending in the vertical direction represents a signal line 1, 2, . . . , n−1, n, n+1, . . . , or, N, and a signal line extending in the horizontal direction represents a selection line 1, 2, . . . , m−1, m, m+1, . . . , or M. The active matrix circuit of the first embodiment is formed on an active matrix circuit substrate 1201 as a rear-surface substrate and has TFTs (Thin Film Transistors) 1001, which are FETs (Field Effect Transistors), as active elements. Taking the TFT 1001 arranged at a coordinate (m,n) as an example, the TFT 1001 has a drain terminal (driving output terminal) 1004 connected to a pixel electrode 1005 as a rear-surface electrode. Furthermore, the TFT 1001 has a source terminal (driving input terminal) 1003 connected to a corresponding signal line n and a gate terminal (status selection terminal) 1002 connected to a corresponding selection line m. The TFT 1001 of the first embodiment is a p-channel TFT constituted of an organic semiconductor, but it may be an n-channel TFT provided that its voltage is adequately changed. Furthermore, a driving unit 1200 of the first embodiment has a controller 309, a memory 310 as a storage unit, a selection-line driver 313, a signal-line driver 311, and a timer 315 as a counting unit. The memory 310 stores display data of display pixels of an image frame to be displayed on the display unit.

Figure 4:
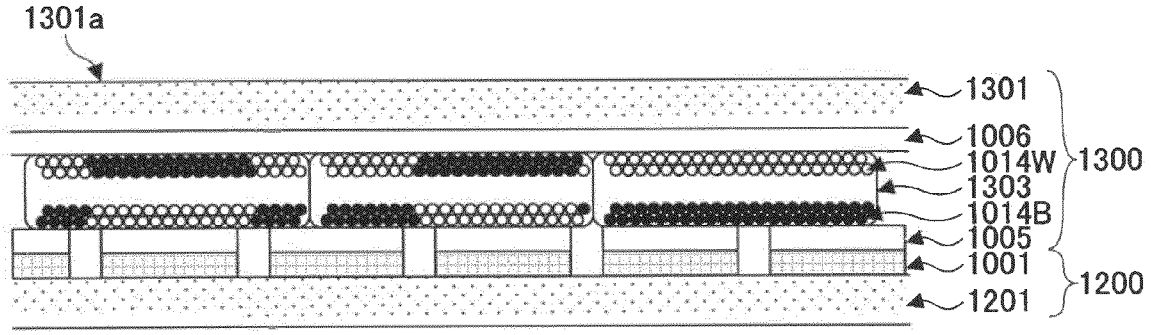
FIG. 4 is a side view schematically showing the cross section of parts of a display unit and the driving unit of the electronic paper.

FIG. 4 is a side view schematically showing the cross section of parts of a display unit 1300 and the driving unit 1200 of the electronic paper.

A display surface 1301*a* of the display unit 1300 is constituted of one surface of a transparent substrate 1301, and a transparent electrode 1006 made, for example, of ITO (Indium Tin Oxide) is formed on the other surface of the transparent substrate 1301. Between the transparent electrode 1006 and pixel electrodes 1005 opposing the transparent electrode 1006, plural capsules 1303 encapsulating two colors of colored particles 1014W and 1014B in white and black as electrophoretic particles are arranged. Note that in the first embodiment the size of the capsules 1303 is larger than that of display pixels, but it may be the same as or smaller than that of the display pixels. In the first embodiment, the colored particles 1014W and 1014B charged to mutually opposite polarities are moved by the action of an electric field. Accordingly, the color, density (brightness), etc., of display pixels on the side of the display surface 1301*a* are adjusted to display an image. Note that the transparent electrode 1006 is common to the pixel electrodes 1005 and connected to ground.

The direction of an electric field generated between the pixel electrodes 1005 and the transparent electrode 1006 is determined by the polarity of a driving voltage to be applied to a corresponding signal line n. Furthermore, a selection voltage to be applied to a corresponding selection line 1, 2, . . . , m−1, m, m+1, . . . , or M controls the application of a driving voltage: the pixel electrodes 105 to which the driving voltage is applied is determined by the selection voltage. Here, the display pixel at a coordinate (m,n) is specifically taken for descriptive purpose. When an active-status selection voltage is applied to the selection line m, it is applied to the gate terminal 1002 of the TFT 1001. As a result, the TFT 1001 is turned on (becomes active). Accordingly, a driving voltage applied to the source terminal 1003 of the TFT 1001 through the signal line n is applied to the pixel electrode 1005 through the drain terminal 1004. On the other hand, when a non-active-status selection voltage is applied to the selection line m, it is applied to the gate terminal 1002 of the TFT 1001. As a result, the TFT 1001 is turned off (becomes non-active). Accordingly, even if the driving voltage is applied from the signal line n to the source terminal 1003 of the TFT 1001, it is not applied to the pixel electrode 1005 connected to the drain terminal 1004.

The colored particles 1014W and 1014B in the capsules 1303 remain at the present position if no driving electric field is generated. On the other hand, if a driving electric field is generated by the application of a display driving voltage, the colored particles 1014W and 1014B in the capsules 1303 are moved in the capsules 1303 in accordance with the direction of the driving electric field as shown in FIG. 4. Accordingly, the color, density (brightness), etc., of display pixels are determined in accordance with the colors of the colored particles 1014W and 1014B moved to the display surface 1301*a* in the capsules 1303. As a result, a white and black image as a whole is displayed on the display surface 1301*a*.

Next, an image display operation in the first embodiment is described.

When a new image frame is displayed on the display unit 1300, the operations unit 308 generates a display-switch starting signal as a display driving instruction and transmits the generated display-switch starting signal to the controller 309, thereby starting display switch processing. The controller 309 first transmits an instruction signal 30F to the selection-line driver 313. In accordance with the received instruction signal 30F, the selection-line driver 313 applies a predetermined selection voltage (active-status selection voltage or non-active-status selection voltage) to the gate terminals 1002 of the TFTs 1001 at given timing through the selection lines 1, 2, . . . , m−1, m, m+1, . . . , and M. The operation statuses of the TFTs 1001 are thus controlled. The instruction signal 30F from the controller 309 includes a control signal for indicating which TFTs 1001 on the selection lines 1, 2, . . . , m−1, m, m+1, . . . , and M are to be turned on and a control signal for determining timing for outputting the active-status selection voltage from the selection-line driver 313. In the first embodiment, the active-status selection voltage is successively applied from 1 to M with respect to the selection lines 1, 2, . . . , m−1, m, m+1, . . . , and M (the non-active-status selection voltage is applied to the selection lines to which the active-status selection voltage is not applied). In the following description, a cycle for applying the active-status selection voltage to the selection lines of 1 through M is referred to as a scanning cycle.

Furthermore, the controller 309 transmits an addressing signal 30B to the memory 310 while transmitting an instruction signal 30D to the signal-line driver 311. With the transmission of the addressing signal 30B, display data of display pixels of an image frame to be displayed are extracted from the memory 310. The display data correspond to patterns to be displayed on the TFTs 1001 of display pixels. The extracted display data 30C are transmitted from the memory 310 to the signal-line driver 311. In accordance with the display data 30C and the instruction signal 30D from the controller 309, the signal-line driver 311 applies a predetermined display driving voltage to the source terminals 1003 of the TFTs 1001 at given timing through the signal lines 1, 2, . . . , n−1, n, n+1, . . . , and N. The instruction signal 30D from the controller 309 includes a control signal for determining timing for outputting the display driving voltage from the signal-line driver 311.

In each of the TFTs 1001, the display driving voltage input to the source terminal 1003 during the time in which the active-status selection voltage is applied to the gate terminal 1002 (time in which the TFT 1001 is turned on) is transmitted to the pixel electrode 1005 through the drain terminal 1004. Accordingly, the potential of the pixel electrode 1005 becomes positive or negative in accordance with the display driving voltage, and a potential difference is caused between the pixel electrode 1005 and the transparent electrode 1006 to generate a driving electric field. Then, either one of the colored particles 1014W and 1014B between the pixel electrode 1005 and the transparent electrode 1006 are moved to the transparent electrode 1006. Accordingly, the color of a display pixel corresponds to that of the colored particles 1014W and 1014B moved to the transparent electrode 1016. The colors of respective display pixels are successively controlled in this manner. When the control of all display pixels is completed, the display switch of an image frame is ended. In the first embodiment, when the display driving voltage has a positive polarity, a driving electric field is generated in which the colored particles 1014B in black are moved to the transparent electrode 1006. On the other hand, when the display driving voltage has a negative polarity, a driving electric field is generated in which the colored particles 1014B in white are moved to the transparent electrode 1006.

Note that the voltage level of the driving voltage applied to the signal lines 1, 2, . . . , n−1, n, n+1, . . . , and N is set by a D/A converter for signal lines (hereinafter referred to as a "DAC for signal lines") 312. Furthermore, the voltage level of the selection voltage applied to the selection lines 1, 2, . . . , m−1, m, m+1, . . . , and M is set by a D/A converter for selection lines (hereinafter referred to as a "DAC for selection lines") 314. The voltage level set by the DAC 312 for signal lines and the DAC 314 for selection lines is determined in accordance with a voltage-level setting signal transmitted from the controller 309. Specifically, the DAC 312 for signal lines and the DAC 314 for selection lines transmit the voltage at a level corresponding to the received voltage-level setting signal from the controller 309 to the signal-line driver 311 and the selection-line driver 313, respectively.

Next, the configuration and operations of preparatory driving which is a characteristic part of the present invention is described.

Figure 5:
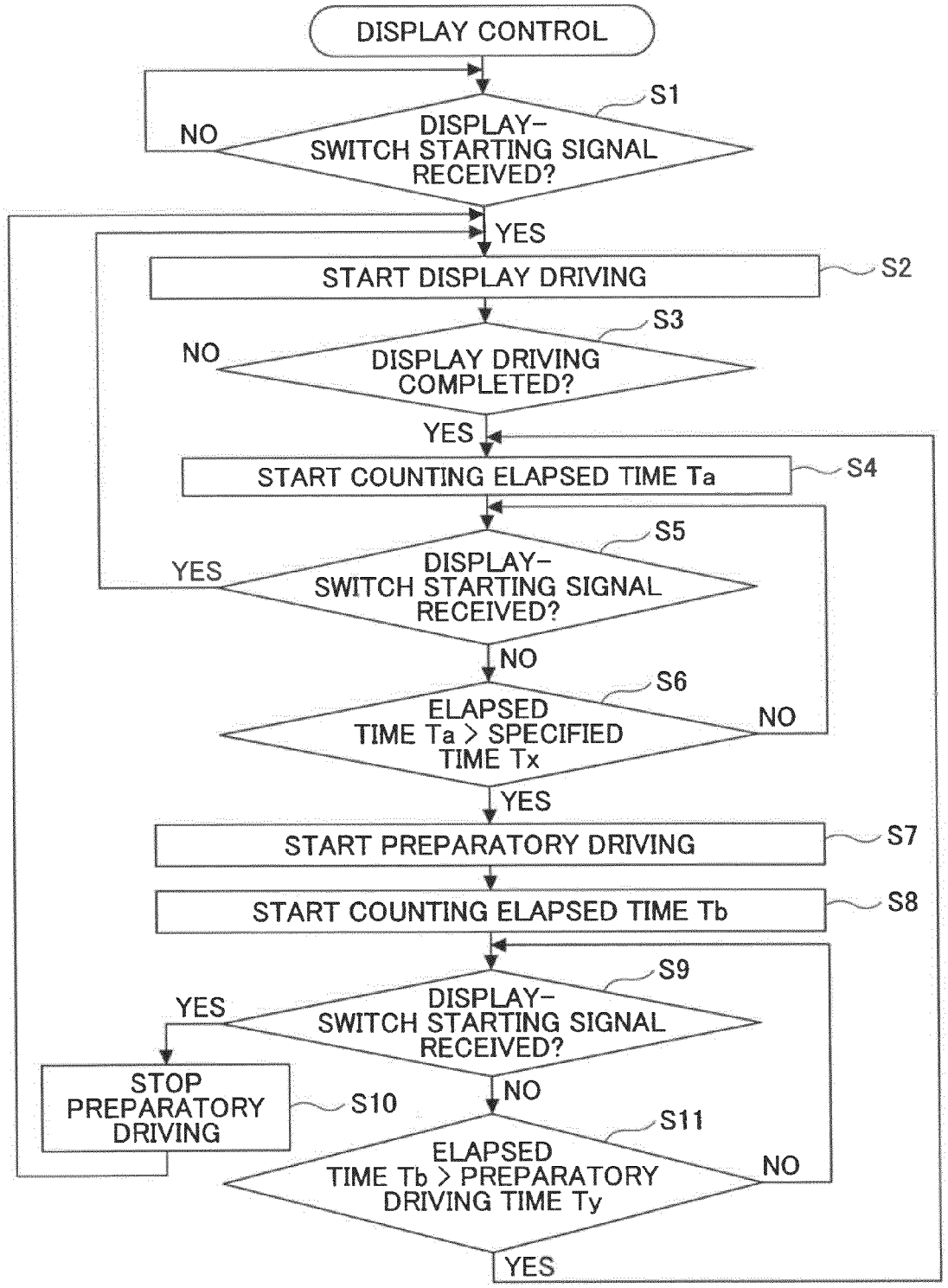
FIG. 5 is a flowchart showing the flow of the display control in the first embodiment.

FIG. 5 is a flowchart showing the flow of the display control in the first embodiment.

After receiving the display-switch starting signal (S1), the controller 309 performs processing such as starting display driving (S2), transmitting the instruction signal 30F to the selection-line driver 313, transmitting the addressing signal 30B to the memory 310, and transmitting the instruction signal 30D to the signal-line driver 311. When the control of all display pixels is completed to thereby end the display driving (S3), the controller 309 outputs a time counting instruction to the timer 315. The timer 315 initializes a time counting value in accordance with the received time counting instruction and then starts counting an elapsed time Ta (S4).

In the first embodiment, a storage unit of the controller 309 stores in advance a specified time Tx for determining preparatory-driving start timing. In determining the specified time Tx, an experiment, etc., is conducted in advance to find an elapsed time which cannot provide a desired response in consideration of a relationship between an elapsed time from the completion of applying a display driving voltage and the response of the colored particles. The specified time Tx can be determined based on the elapsed time thus found. Accordingly, for example, if a desired response cannot be provided when 10 minutes elapse from the completion of applying a display driving voltage, the specified time Tx is set to be shorter than 10 minutes.

After the timer 315 starts counting the elapsed time Ta, the controller 309 determines whether the elapsed time Ta counted by the timer 315 exceeds the specified time Tx (S6). In this case, if the controller 309 receives the next display-switch starting signal before determining that the elapsed time Ta exceeds the specified time Tx (S5), it starts the display driving in accordance with the display-switch starting signal (S2). On the other hand, if the controller 309 determines that the elapsed time Ta exceeds the specified time Tx without receiving the display-switch starting signal (Yes in S6), it starts the preparatory driving (S7).

Figure 6A:
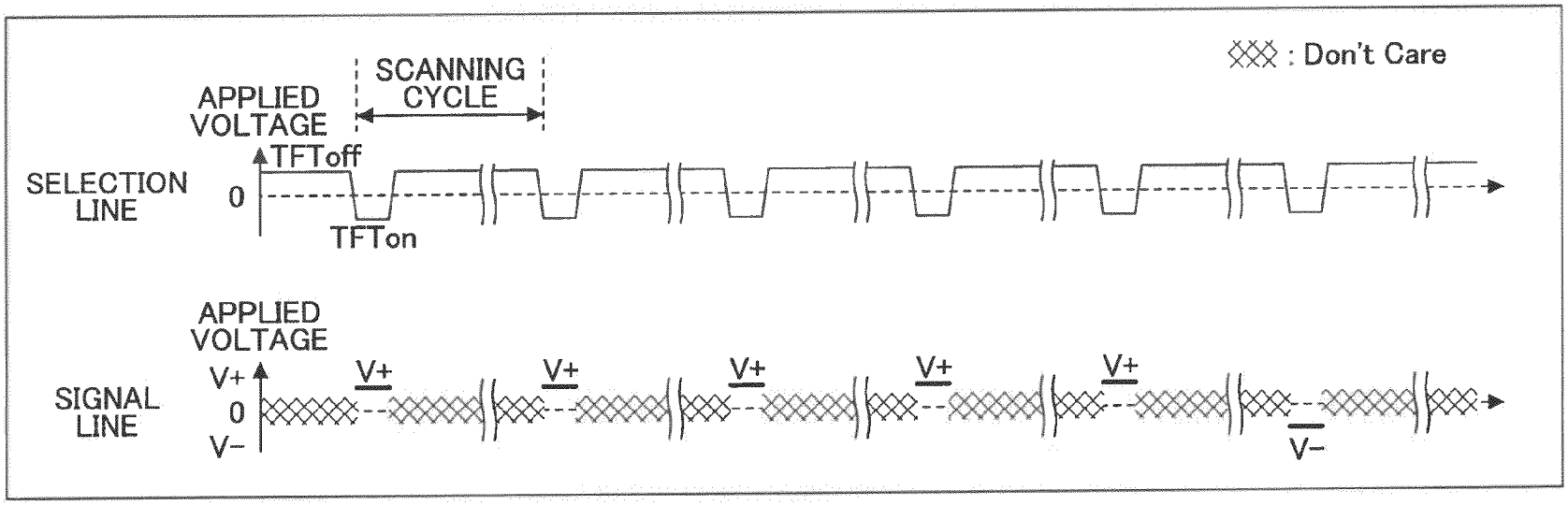
FIG. 6A is a timing chart of a preparatory driving voltage and a status selection voltage applied to the electrodes of display pixels that display an image in black with the application of a previous display driving voltage.

FIG. 6A is a timing chart of a preparatory driving voltage and a status selection voltage applied to the electrodes 1005 of display pixels that display an image in black with the application of a previous display driving voltage.

Figure 6B:
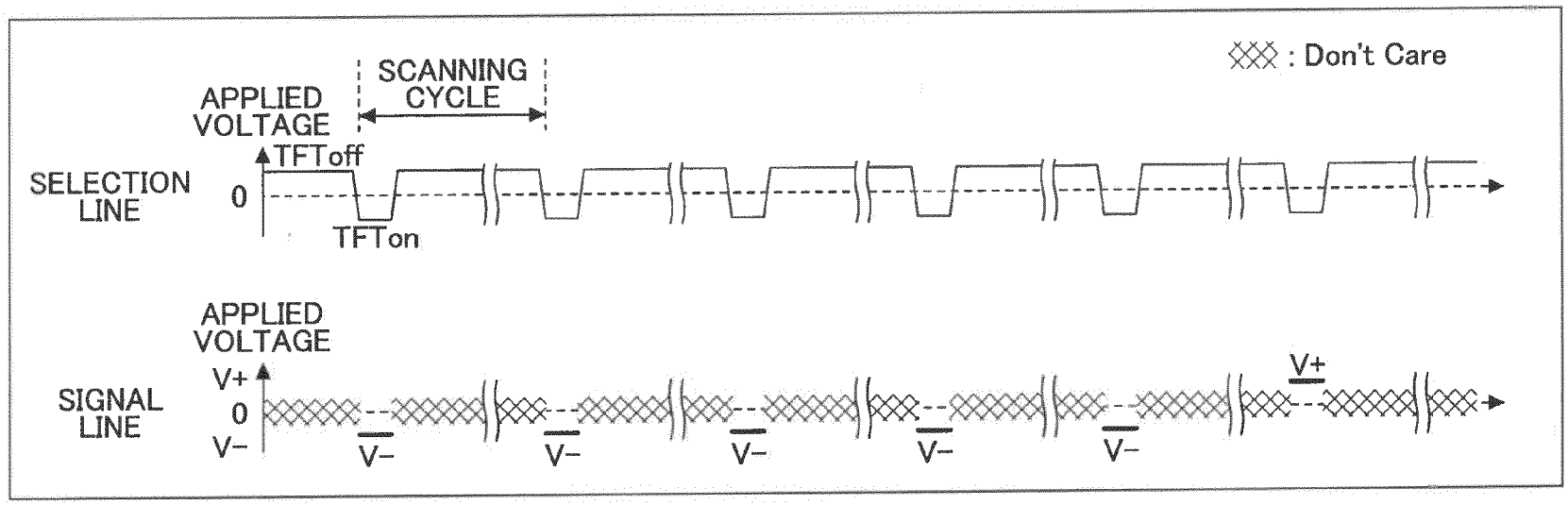
FIG. 6B is a timing chart of the preparatory driving voltage and the status selection voltage applied to the electrodes of display pixels that display an image in white with the application of a previous display driving voltage.

FIG. 6B is a timing chart of the preparatory driving voltage and the status selection voltage applied to the electrodes 1005 of display pixels that display an image in white with the application of a previous display driving voltage.

Figure 6C:
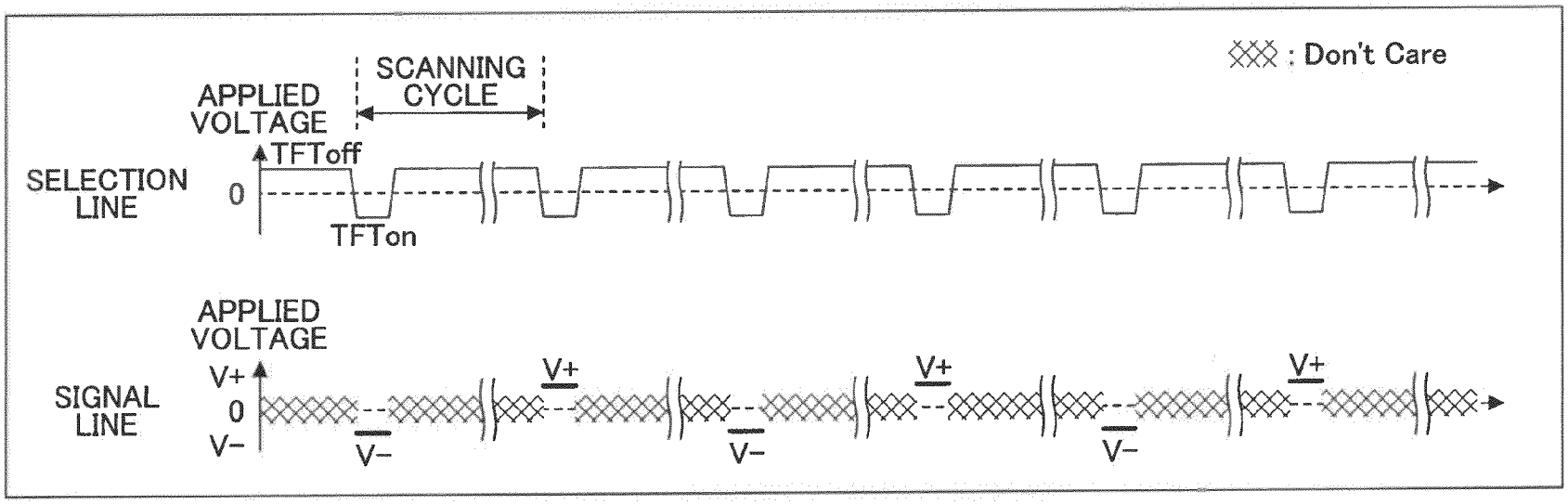
FIG. 6C is a timing chart of the preparatory driving voltage and the status selection voltage applied to the electrodes of display pixels that display an image in gray with the application of a previous display driving voltage.

FIG. 6C is a timing chart of the preparatory driving voltage and the status selection voltage applied to the electrodes 1005 of display pixels that display an image in gray with the application of a previous display driving voltage.

Note that in this embodiment, the preparatory driving voltage applied to each of the display pixels is different in accordance with the previous display driving voltage applied between the pixel electrodes 1005 corresponding to the display pixels and the transparent electrode 1006. However, the same preparatory driving voltage may be applied to all display pixels regardless of the previous display driving voltage.

Display data (display data of a presently-displayed image) corresponding to a previous display-switch starting signal are stored in the memory 310. Therefore, the controller 309 can identify the display driving voltage applied to each of the pixel electrodes 1005 in accordance with the previous display-switch starting signal. The controller 309 first reads the display data from the memory 310 and identifies the present display status (black, white, or gray) of the display pixels 1005 from the display driving voltage previously applied to the display pixels 1005 based on the display data. Then, the controller 309 sets the preparatory driving voltage for each of the display pixels 1005 in accordance with the display statuses of the identified display pixels 1005. Furthermore, in determining a single preparatory driving time Ty where the preparatory driving voltage is applied, an experiment, etc., is conducted in advance to find time required for properly restoring the response of the colored particles after the elapse of the above specified time Tx with the application of the preparatory driving voltage. The preparatory driving time Ty is determined based on the required time.

In this embodiment, as shown in FIGS. 6A through 6C, the selection lines 1, 2, . . . , m−1, m, m+1, . . . , and M are scanned plural times during the single preparatory driving time Ty. In other words, the active-status selection voltage is applied to the selection lines 1, 2, . . . , m−1, m, m+1, . . . , and M plural times during the single preparatory driving time Ty. Accordingly, the preparatory driving voltage is applied to the signal lines 1, 2, . . . , n−1, n, n+1, . . . , and N plural times.

In this embodiment, the preparatory driving voltage is applied to any of the display pixels so as to generate a preparatory electric field that changes the strength of an electric field during the preparatory driving time Ty. The preparatory electric field is capable of improving the response of the colored particles 1014W and 1014B even if it changes only its size without changing its direction. However, it is more effective to use an alternating electric field that changes not only its size but also its direction in order to improve the response of the colored particles 1014W and 1014B. Accordingly, in this embodiment, two types of the preparatory driving voltages each having a positive polarity and a negative polarity are set to be applied to the pixel electrodes 1005 so that the alternating electric field is generated in all the display pixels during the preparatory driving time Ty.

Specifically, as shown in FIG. 6A, in the case of display pixels presently displayed in black, the polarity of the preparatory driving voltage applied during the preparatory driving time Ty is biased to the positive polarity the same as that of the display driving voltage previously applied to the display pixels. For example, the application time ratio of the preparatory driving voltage having the positive polarity to the preparatory driving voltage having the negative polarity is set to be 5:1.

Furthermore, as shown in FIG. 6B, in the case of display pixels presently displayed in white, the polarity of the preparatory driving voltage applied during the preparatory driving time Ty is biased to be the negative polarity the same as that of the display driving voltage previously applied to the display pixels. For example, the application time ratio of the preparatory driving voltage having the positive polarity to the preparatory driving voltage having the negative polarity is set to be 1:5.

Furthermore, as shown in FIG. 6C, in the case of display pixels presently displayed in gray, the application time ratio of the preparatory driving voltage having the positive polarity to the preparatory driving voltage having the negative polarity is set to be 1:1. In this case, it is preferable that the polarity of the preparatory driving voltage be switched for every scanning cycle.

The application time ratio of the preparatory driving voltage having the positive polarity to the preparatory driving voltage having the negative polarity, the amount of the preparatory driving voltage having the positive/negative polarity, and the preparatory driving time Ty are properly set so that the display statuses of the display pixels are not changed by the application of the preparatory driving voltage. For example, in the case of the display pixels displayed in black, if the application time ratio of the preparatory driving voltage having the positive polarity is too large or if the amount of the preparatory driving voltage having the positive polarity is too large, an excessive electric field is caused to act in the direction (for displaying the display pixels in black) in which the colored particles 1014B in black are moved to the display surface 1301*a* and the colored particles 1014W in white are moved to the rear surface. As a result, the effect of improving the response of the colored particles 1014W and 1014B is reduced. Conversely, if the application time ratio of the preparatory driving voltage having the negative polarity is too large or if the amount of the preparatory driving voltage having the negative polarity is too large, an excessive electric field is caused to act in the direction (for displaying the display pixels in white) in which a part of the colored particles 1014B in black is moved to the rear surface and a part of the colored particles 1014W in white is moved to the display surface 1301*a*. As a result, the present display status cannot be maintained. For this reason, the application time ratio of the preparatory driving voltage having the positive polarity to the preparatory driving voltage having the negative polarity, the amount of the preparatory driving voltage having the positive/negative polarity, and the preparatory driving time Ty are set to be an optimum value based on an experiment, simulation, etc.

Figure 7:
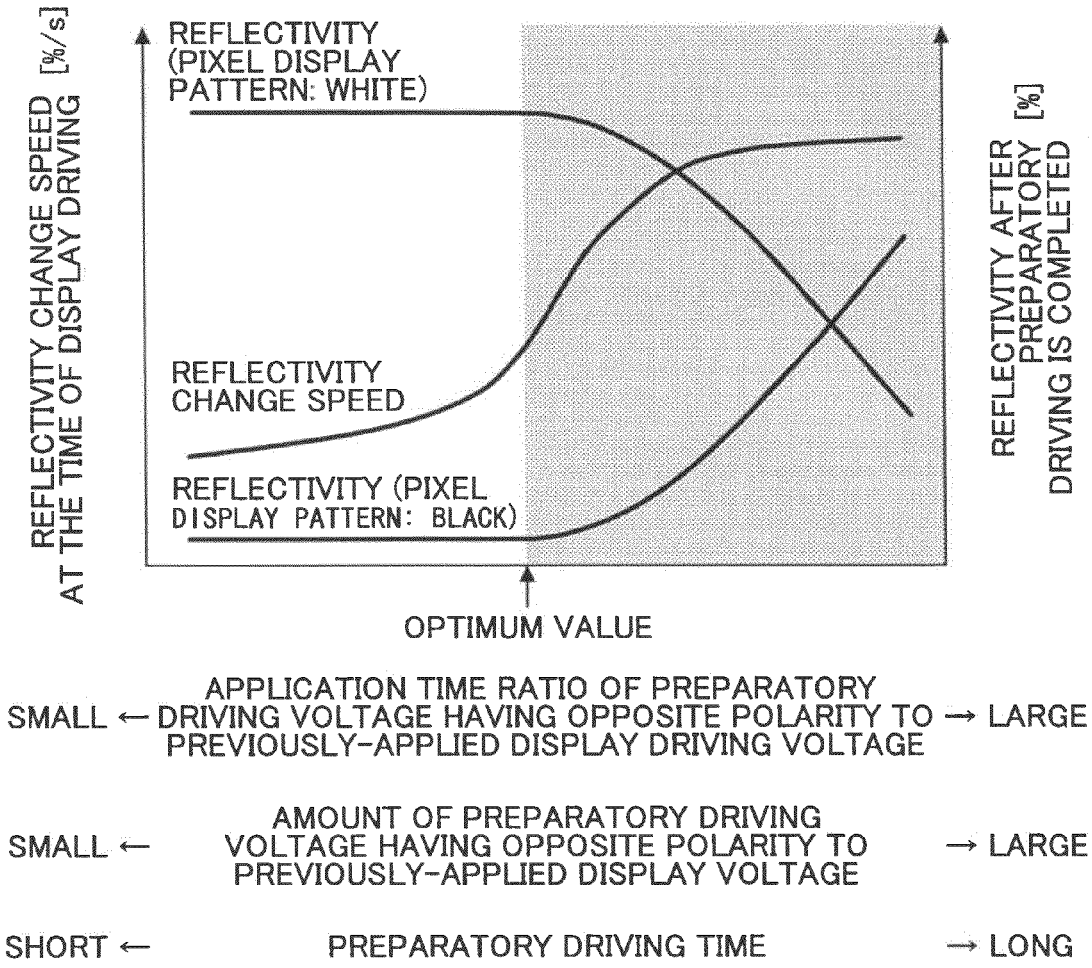
FIG. 7 is a graph showing a relationship between the application time ratio of a preparatory driving voltage having a positive polarity to a preparatory driving voltage having a negative polarity, the amount of the preparatory driving voltage having the positive/negative polarity, and a preparatory driving time and reflectivity change speed at the time of display driving and reflectivity at the time of preparatory driving.

FIG. 7 is a graph showing a relationship between the application time ratio of the preparatory driving voltage having the positive polarity to the preparatory driving voltage having the negative polarity, the amount of the preparatory driving voltage having the positive/negative polarity, and the preparatory driving time Ty and reflectivity change speed at the time of the display driving and reflectivity at the time of the preparatory driving.

If the application time ratio of the preparatory driving voltage having the opposite polarity to that of the display driving voltage previously applied and the amount thereof are made larger and the preparatory driving time Ty is made longer, the reflectivity change speed at the time of the next display driving is increased. Accordingly, it is found that the effect of improving the response of the colored particles 1014W and 1014B is enhanced. In this case, however, the reflectivity at the time of the preparatory driving is likely to be changed, which results in difficulty in maintaining the present display status. An area in gray shown in FIG. 7 is an area in which the reflectivity before the preparatory driving cannot be maintained after the completion of the preparatory driving, namely, an area in which the display status before the preparatory driving cannot be maintained. Accordingly, the optimum values of the application time ratio of the preparatory driving voltage having the positive polarity to the preparatory driving voltage having the negative polarity, the amount of the preparatory driving voltage having the positive/negative polarity, and the preparatory driving time Ty should not fall in the area in gray. In addition, the application time ratio of the preparatory driving voltage having the opposite polarity to that of the display driving voltage previously applied should be made large. Moreover, the preparatory driving time Ty should be longer.

Furthermore, the optimum values of the application time ratio of the preparatory driving voltage having the positive polarity to the preparatory driving voltage having the negative polarity, the amount of the preparatory driving voltage having the positive/negative polarity, and the preparatory driving time Ty are changed in accordance with the aggregability of the colored particles, the adhesion of the colored particles to the inner walls of the capsules, etc. That is, the curved lines of the graph shown in FIG. 7 are likely to be shifted as a whole to the right side if the degree of the aggregability and the adhesion is large or to the left side if the degree thereof is small. The degree of the aggregability and the adhesion depends on material characteristics of the colored particles 1014W and 1014B used, operating characteristics of the TFTs 1001, the elapsed time Ta from the completion of applying the previous display driving voltage, etc. Accordingly, the optimum values of the application time ratio of the preparatory driving voltage having the positive polarity to the preparatory driving voltage having the negative polarity, the amount of the preparatory driving voltage having the positive/negative polarity, and the preparatory driving time Ty are also determined in consideration of the material characteristics of the colored particles 1014W and 1014B, the operating characteristics of the TFTs 1001, the elapsed time Ta from the completion of applying the previous display driving voltage, etc.

As described in this embodiment, even if the amount of the preparatory driving voltage is set to be relatively large, the arrangement of the colored particles 1014W and 1014B of the display pixels can be stably maintained by making the polarity of the preparatory driving voltage applied to the pixel electrodes 1005 the same as that of the previous display driving voltage. Accordingly, it is possible to effectively improve the response of the colored particles 1014W and 1014B in a shorter preparatory driving time while maintaining the display statuses of the display pixels.

Note that in this embodiment, the polarity of the preparatory driving voltage is biased to be the same polarity as that of the previous display driving voltage by changing the application time ratio of the preparatory driving voltage having the positive polarity to the preparatory driving voltage having the negative polarity, but other methods may be used. For example, while making the application time ratio of the preparatory driving voltage having the positive polarity to the preparatory driving voltage having the negative polarity constant (for example, the polarity of the preparatory driving voltage is set to be switched for every scanning cycle), the amount of the preparatory driving voltage having the same polarity as that of the previous display driving voltage may be greater than the preparatory driving voltage having the opposite polarity.

On the other hand, the polarity of the preparatory driving voltage applied to the pixel electrodes 1005 may be set to be opposite to that of the previous display driving voltage. In this case, the effect of reducing the adhesion of the colored particles 1014W and 1014B to the inner walls of the capsules is enhanced. Therefore, it is possible to effectively improve the response of the colored particles 1014W and 1014B in a shorter preparatory driving time. Note, however, that if the preparatory driving time is set to be too long, the arrangement of the colored particles 1014W and 1014B is changed, which may not maintain the display statuses of the display pixels.

In order to start the above preparatory driving, the controller 309 outputs a time counting instruction to the timer 315. The timer 315 initializes the time counting value in accordance with the received time counting instruction and then starts counting an elapsed time Tb (S8). After the timer 315 starts counting the elapsed time Tb, the controller 309 determines whether the elapsed time Tb counted by the timer 315 exceeds the preparatory driving time Ty (S11). In this case, if the controller 309 receives the next display-switch starting signal before determining that the elapsed time Tb exceeds the preparatory driving time Ty, namely, during the preparatory driving time (S9), it suspends the application of the preparatory driving voltage to all the display pixels to stop the preparatory driving (S10). Then, the controller 309 starts the display driving in accordance with the received display-switch starting signal (S2). On the other hand, if the controller 309 determines that the elapsed time Tb exceeds the preparatory driving time Ty without receiving the display-switch starting signal (Yes in S11), it outputs the time counting instruction to the timer 315 and causes the timer 315 to count the elapsed time Ta again (S4). Accordingly, if the controller 309 does not receive the next display-switch starting signal until the specified time Tx further elapses from the completion of the present preparatory driving (S5 and S6), it repeats the preparatory driving again. Note that the specified time for determining whether the second and subsequent preparatory driving operations are performed may be different from the specified time Tx for determining whether the first preparatory driving operation is performed.

Note that in the first embodiment, the preparatory driving for all the display pixels is stopped if the controller 309 receives the display-switch starting instruction during the preparatory driving time (S9). Alternatively, the preparatory driving only for the display pixels, in which the arrangement of the colored particles 1014W and 1014B is changed by the driving electric field based on the display driving voltage applied in accordance with the display-switch starting instruction, may be stopped. In other words, the preparatory driving for the display pixels, in which the arrangement of the colored particles 1014W and 1014B is not changed by the display-switch starting instruction, may be continued.

Furthermore, in the first embodiment, the controller 309 necessarily performs the preparatory driving when the elapsed time Ta exceeds the specified time Tx, but it may not perform the preparatory driving in accordance with a predetermined condition. For example, when the user configures the settings so as not to perform the preparatory driving, the preparatory driving may not be performed even if the elapsed time Ta exceeds the specified time Tx.

(Modified Embodiment)

Next, a description is made of a modified embodiment of the control of the preparatory driving in the first embodiment.

In the first embodiment, the specified time Tx is constant. However, the specified time Tx is preferably changed in accordance with conditions. For example, when the specified time Tx is set to be short, the preparatory driving is frequently performed. Therefore, although a high response of the colored particles 1014W and 1014B can be stably ensured when the controller 309 applies the display driving voltage after receiving the next display-switch starting instruction, electric power consumption due to the preparatory driving is increased. Accordingly, when the preparatory driving is frequently performed while the electronic paper is driven by a battery, available time of the electronic paper is reduced. In such a case, it is sometimes preferred to make the specified time Tx longer to ensure the available time even if the response of the colored particles is somewhat degraded. In this modified embodiment, an example of changing the specified time Tx is described.

Figure 8:
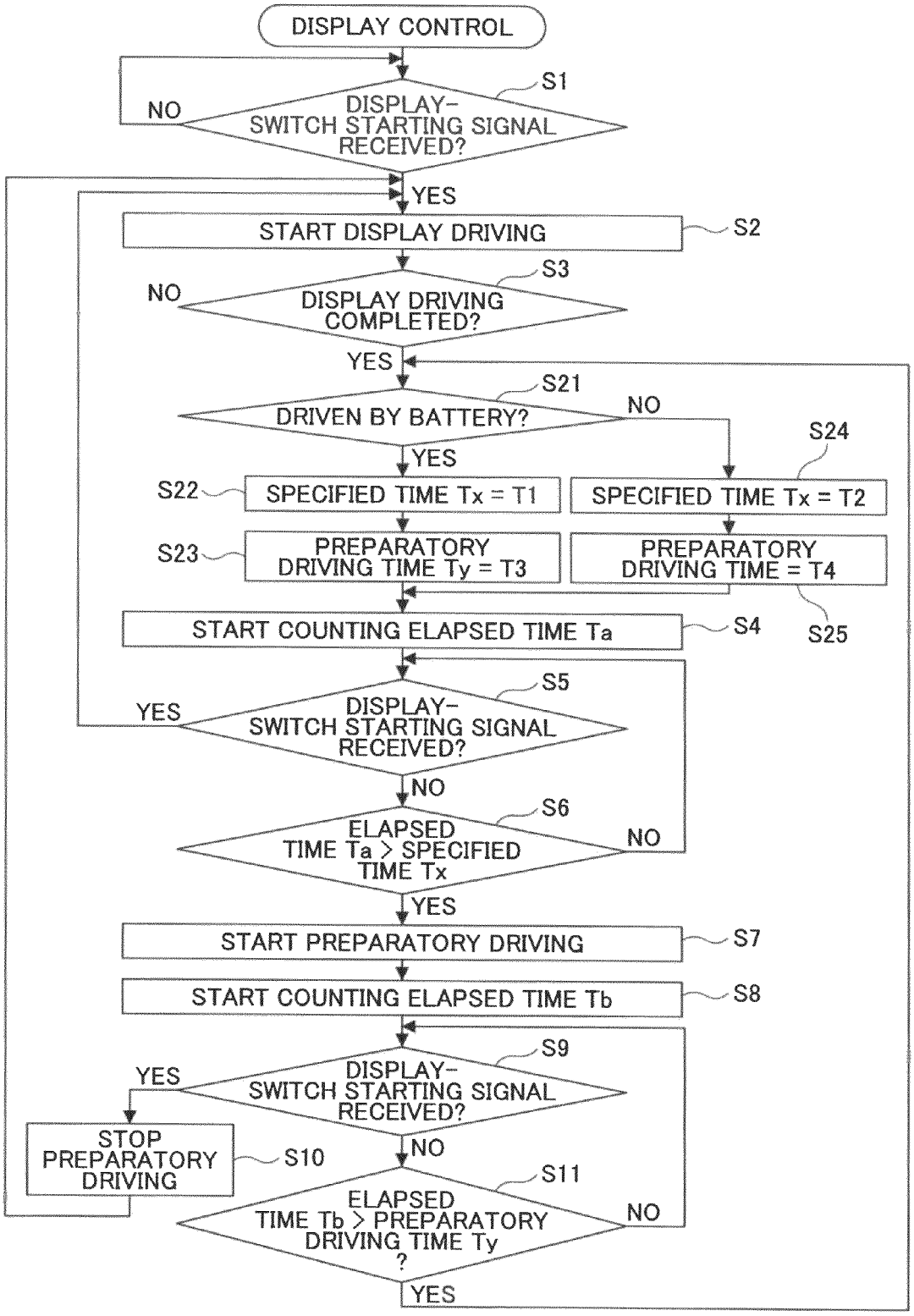
FIG. 8 is a flowchart showing the flow of the display control in a modified embodiment.

FIG. 8 is a flowchart showing the flow of the display control in the modified embodiment.

Note that a basic flow of the display control is the same as that of the first embodiment. Therefore, only a characteristic part of the modified embodiment is described below.

The electronic paper of the modified embodiment is driven by electric power supplied from an external electric power supply if it is connected to the external electric power supply, or it is driven by electric power supplied from an internal battery if it is not connected to the external electric power supply. In the modified embodiment, the specified time Tx is switched depending on whether the electronic paper is driven by the battery or the external electric power supply. Specifically, when the control of all the display pixels is completed to thereby end the display driving (S3), the controller 309 determines whether the electronic paper is being driven by the battery (S21) before causing the timer 315 to count the elapsed time Ta (S4). If it is determined that the electronic paper is being driven by the battery, the controller 309 sets the specified time Tx to be T1 (S22) and the preparatory driving time Ty to be T3 (S23). On the other hand, if it is determined that the electronic paper is being driven by the external electric power supply, the controller 309 sets the specified time Tx to be T2 (S24) and the preparatory driving time Ty to be T4 (S25). Note that a relationship between T1 and T2 is T1>T2, and a relationship between T3 and T4 is T3>T4.

In the modified embodiment, the specified time Tx is set to be T2 when the electronic paper is driven by the external electric power supply. Therefore, the frequency of the preparatory driving when the electronic paper is driven by the external electric power supply is greater than that of the preparatory driving when the electronic paper is driven by the battery. As a result, the high response of the colored particles 1014W and 1014B can be stably ensured when the controller 309 applies the display driving voltage after receiving the next display-switch starting instruction, thereby making it possible to perform the display switch at high speed. On the other hand, the specified time Tx is set to be T1 when the electronic paper is driven by the battery. Therefore, the frequency of the preparatory driving when the electronic paper is driven by the battery is smaller than that of the preparatory driving when the electronic paper is driven by the external electric power supply. As a result, the high response of the colored particles 1014W and 1014B cannot be ensured as in the case when the electronic paper is driven by the external electric power supply. In this case, however, electric power consumption due to the preparatory driving can be reduced. Therefore, the available time of the electronic paper can be made longer, thus improving the convenience for the user. Note that in the modified embodiment, the specified time Tx is changed depending on whether the electronic paper is being driven by the battery or the external electric power supply. However, the change condition is not limited to this.

Furthermore, in the modified embodiment, the longer the specified time Tx is, the longer the preparatory driving time Ty becomes. This is because, as the specified time Tx is longer, the aggregation of the colored particles and the adhesion of the colored particles to the inner walls of the capsules at the time of starting the preparatory driving becomes stronger. Therefore, the modified embodiment aims to enhance the effect of improving the response of the colored particles by making the preparatory driving time Ty longer. However, according to conditions, the preparatory driving time Ty may be made shorter or be constant as the specified time Tx is longer.

(Second Embodiment)

Next, a description is made of another embodiment (hereinafter referred to as a "second embodiment") in which the present invention is applied to electronic paper as an image display device.

In the first embodiment, the controller 309 starts the preparatory driving on the condition that it does not receive the next display-switch starting instruction until the elapsed time Ta from the completion of applying the previous display driving voltage exceeds the specified time Tx. Note that the same applies to a case in which the controller 309 starts the preparatory driving on the condition that it does not receive the next display-switch starting instruction until the elapsed time Ta from the starting of applying the previous display driving voltage exceeds the specified time Tx. In other words, in the first embodiment, the timing for starting the preparatory driving is determined based on the time when the application of the previous display driving voltage is completed. In the second embodiment, the controller 309 starts the preparatory driving based on a condition different from that of the first embodiment.

Figure 9:
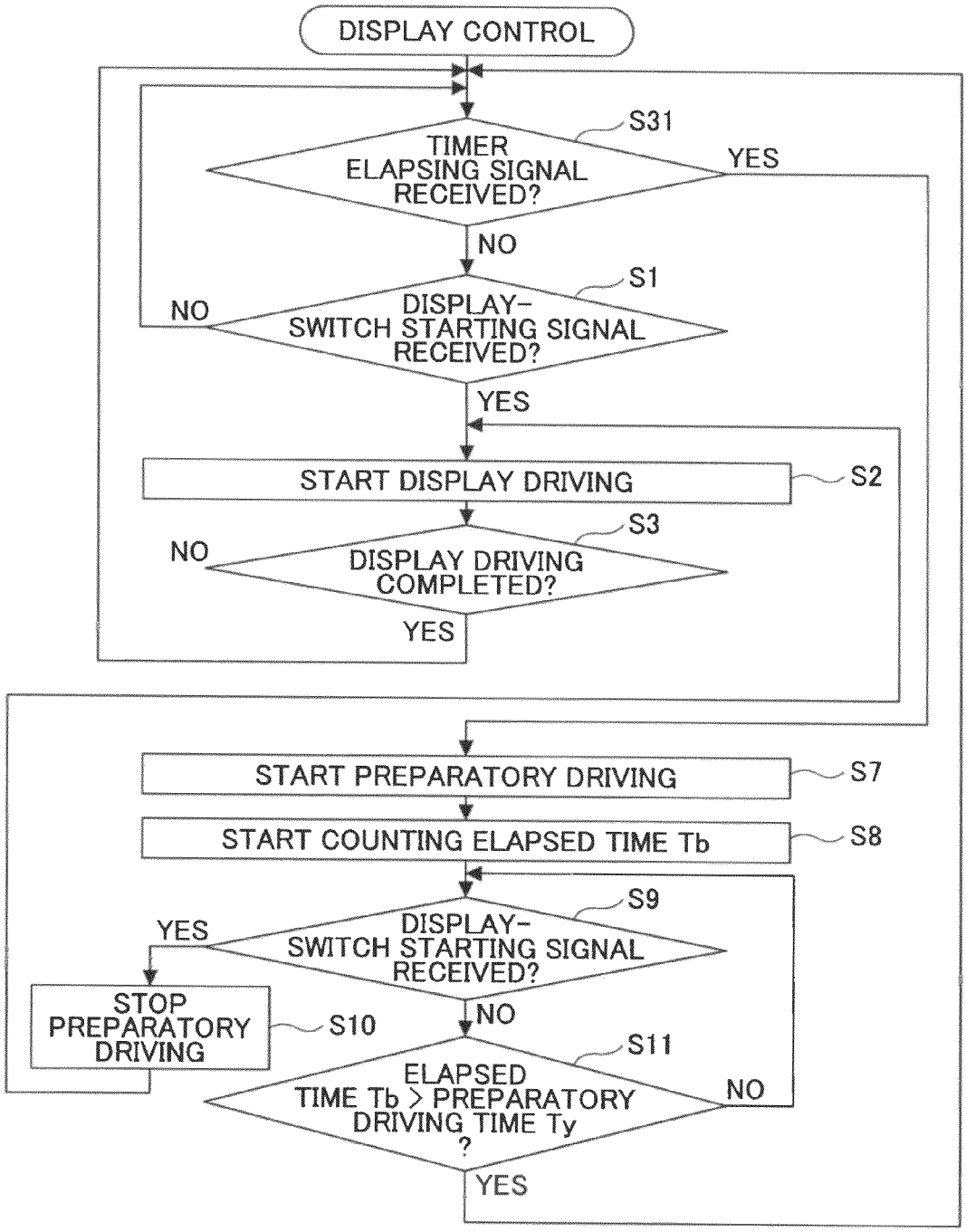
FIG. 9 is a flowchart showing the flow of the display control in a second embodiment.

FIG. 9 is a flowchart showing the flow of the display control in the second embodiment.

Note that a basic flow of the display control is the same as that of the first embodiment. Therefore, only a characteristic part of the second embodiment is described below.

In the second embodiment, the timer 315 outputs a timer elapsing signal to the controller 309 every time it counts a specified time Tz. Then, the controller 309 starts the preparatory driving (S7) after receiving the timer elapsing signal from the timer 315 (S3). Accordingly, in the second embodiment, the controller 309 performs the preparatory driving at the predetermined time interval (specified time Tz) regardless of the time when the application of the display driving voltage is started or completed. In determining the specified time Tz, an experiment, etc., is conducted in advance to find an elapsed time which cannot provide a desired response in consideration of a relationship between an elapsed time from the completion of applying the display driving voltage and the response of the colored particles. The specified time Tz can be determined based on the elapsed time thus found. Accordingly, for example, if the desired response cannot be provided when 30 minutes elapse from the completion of applying the display driving voltage, the specified time Tz is set to be shorter than 30 minutes so that the desired response is constantly provided.

(Third Embodiment)

Next, a description is made of still another embodiment (hereinafter referred to as a "third embodiment") in which the present invention is applied to electronic paper as an image display device.

In the third embodiment, the controller starts the preparatory driving based on a condition different from those of the first and second embodiments.

Figure 10:
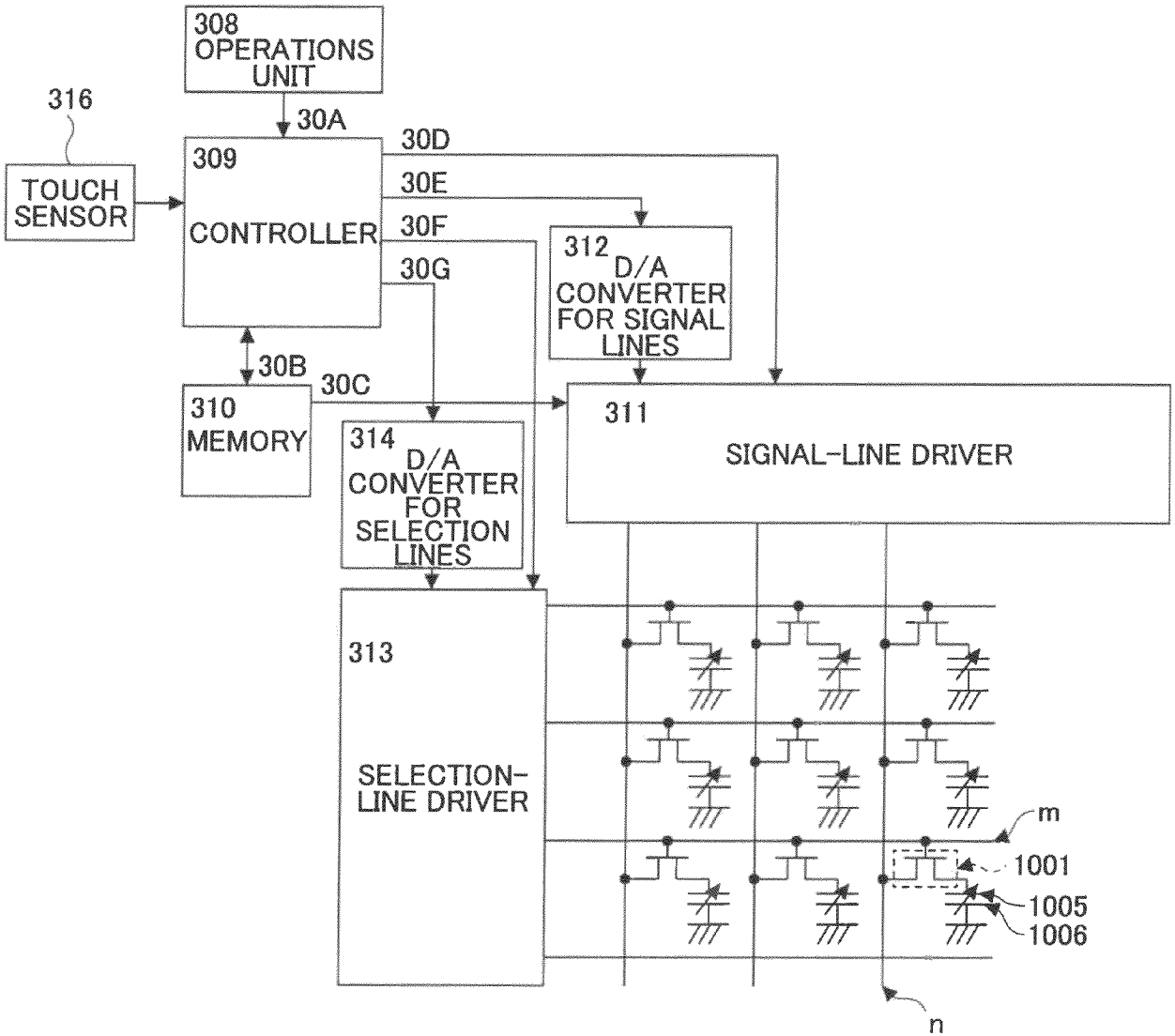
FIG. 10 is a block diagram showing a schematic configuration of a driving unit of electronic paper according to a third embodiment.

FIG. 10 is a block diagram showing a schematic configuration of a driving unit of the electronic paper according to the third embodiment.

In the third embodiment, a touch sensor 316 as an external information detection unit is connected to the controller 309 instead of the timer 315. The touch sensor 316 is a known sensor that detects whether the electronic paper is being held by the user. Upon detecting that the electronic paper is being held by the user, the touch sensor 316 outputs a predetermined output signal to the controller 309.

Figure 11:
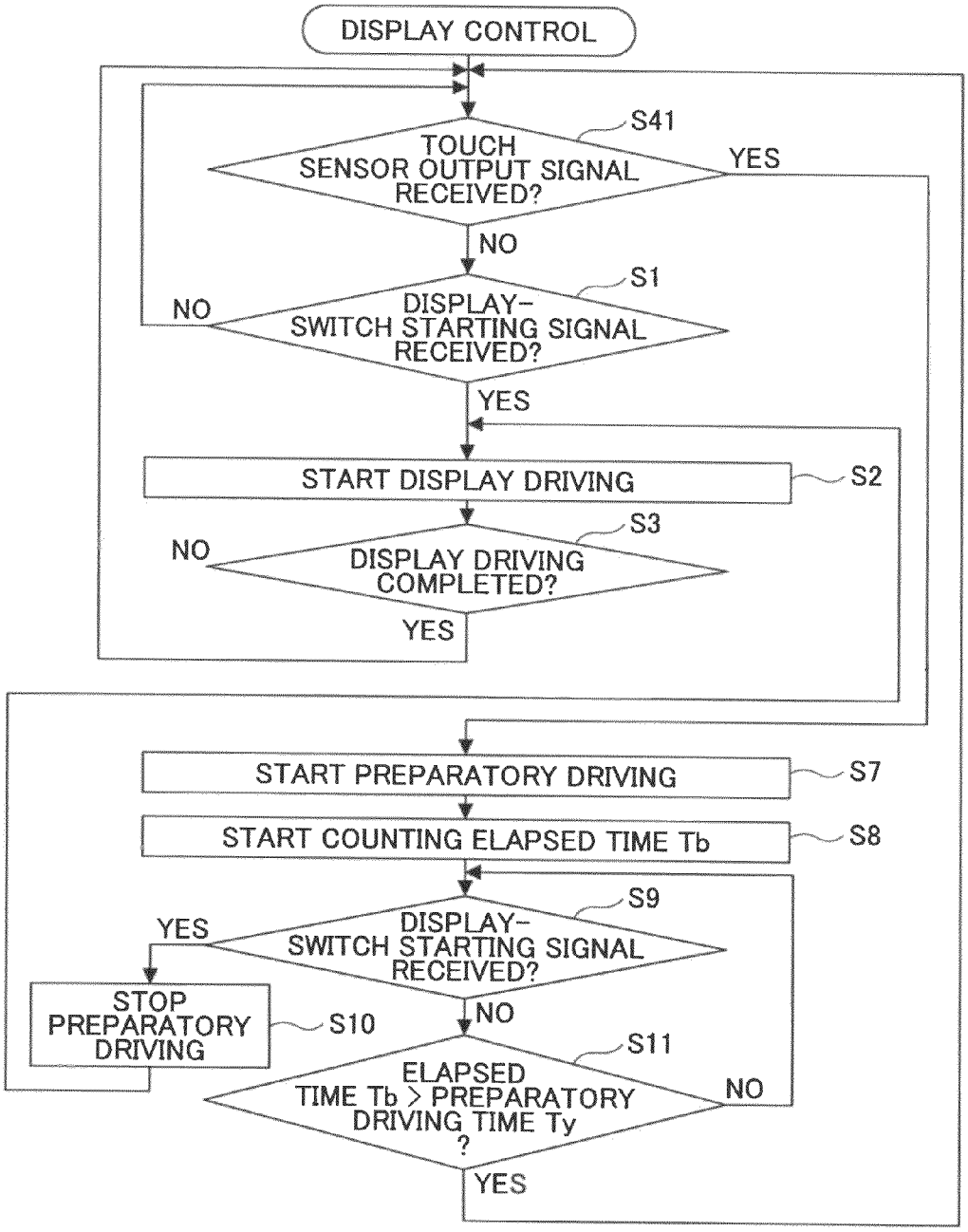
FIG. 11 is a flowchart showing the flow of the display control in the third embodiment.

FIG. 11 is a flowchart showing the flow of the display control in the third embodiment.

Note that a basic flow of the display control is the same as that of the first embodiment. Therefore, only a characteristic part of the third embodiment is described below.

In the third embodiment, when the touch sensor 316 detects that the electronic paper is being held by the user, it outputs the predetermined output signal to the controller 309. The controller 309 functions as a use-status determination unit. When the controller receives the predetermined output signal from the touch sensor 316 (S41), it determines that the electronic paper is in use and starts the preparatory driving (S7). Accordingly, in the third embodiment, the controller 309 determines the timing for starting the preparatory driving based on the use status of the electronic paper regardless of the time when the application of the display driving voltage is started or completed.

Note that in the third embodiment, the controller 309 performs the preparatory driving when the electronic paper is held by the user, but it may perform the preparatory driving when the electronic paper is not held by the user.

Furthermore, in the third embodiment, external information for determining whether the electronic paper is being held by the user is based on contact information when the electronic paper is being held by the user. However, other information may be used so long as it is useful for determining whether the electronic paper is being held by the user. For example, a light detection sensor may be used as the external information detection unit. In this case, the light detection sensor is capable of determining that the electronic paper is not being used by the user when it does not detect light.

As described above, the electronic paper according to the first embodiment (including the modified embodiment) is the image display device that has the display unit 1300 and the driving unit 1200. In the display unit 1300, the colored particles 1014W and 1014B as the electrophoretic particles are provided between the transparent electrode 1006 on the transparent substrate 1301 and the pixel electrodes 1005 as the rear-surface electrodes on the active matrix circuit substrate 1201. The pixel electrodes 1005 and the transparent electrode 1006 are provided for each of the plural display pixels constituting a display image. Furthermore, in the display unit 1300, the driving electric field, which moves the colored particles 1014W and 1014B to the pixel electrodes 1005 or the transparent electrode 1006, is generated between the pixel electrodes 1005 and the transparent electrode 1006 for each of the display pixels. Accordingly, when the colored particles 1014W and 1014B are moved, the display status of each of the display pixels is changed. The driving unit 1200 applies, after receiving the display-switch starting signal as the display driving instruction, the display driving voltage for controlling the driving electric field of each of the display pixels to at least one of the pixel electrodes 1005 and the transparent electrode 1006 for each of the display pixels between the pixel electrodes 1005 and the transparent electrode 1006. In the image display device, even after the driving unit 1200 completes the application of the display driving voltage, the arrangement of the colored particles 1014W and 1014B corresponding to the display driving voltage is maintained, which results in maintaining the display status of the display image. Then, when the driving unit 1200 does not apply the next display driving voltage even after the specified time Tx (predetermined time) elapses from the completion of applying the previous display driving voltage, it applies the preparatory driving voltage for generating the preparatory electric field capable of improving the response of the colored particles 1014W and 1014B to the driving electric field to an extent so as not to change the arrangement of the colored particles 1014W and 1014B between the pixel electrodes 1005 and the transparent electrode 1006 for the predetermined preparatory driving time Ty. Accordingly, the preparatory electric field is caused to act on the colored particles 1014W and 1014B, thereby making it possible for the colored particles 1014W and 1014B to easily move when the driving unit 1200 applies the next display driving voltage. In addition, the preparatory driving voltage is less likely to be applied until the driving unit 1200 applies the display driving voltage after receiving the display-switch starting signal. Accordingly, display switch time until the driving unit 1200 applies the display driving voltage after receiving the display-switch starting signal to complete the display switch of an image can be reduced. As a result, the display switch of the image can be performed at high speed.

Particularly, in the first embodiment, when another predetermined time (Tx+Tx) longer than the specified time Tx elapses in a state in which the next display driving voltage is not applied from the completion of applying the previous display driving voltage after the application of the preparatory driving voltage, the driving unit applies a voltage the same as the preparatory driving voltage. Accordingly, even if the next display driving voltage is applied to perform the display switch of the image after a long time elapses from the completion of applying the previous display driving voltage, the display switch of the image can be stably performed at high speed.

Furthermore, in the first embodiment, the driving unit 1200 has the timer 315 as a counting unit that counts the elapsed time Ta from the completion of applying the previous display driving voltage and the controller 309 as a determination unit that determines whether the elapsed time Ta counted by the timer 315 exceeds the specified time Tx without the application of the next display driving voltage. The driving unit 1200 starts the application of the preparatory driving voltage when it is determined that the elapsed time Ta exceeds the specified time Tx. Accordingly, the preparatory driving voltage can be applied at minimum and appropriate timing.

Furthermore, as described in the modified embodiment, the controller 309 functions as a change unit that changes the specified time Tx in accordance with the predetermined change condition, i.e., the condition whether the electronic paper is being driven by the battery or the external electric power supply. Because the specified time Tx is thus changed, the preparatory driving voltage can be applied at an appropriate time interval in accordance with conditions after the completion of applying the previous display driving voltage.

In this case, as the specified time Tx changed by the controller 309 is longer, it is preferred to make the predetermined preparatory driving time Ty after the elapse of the changed specified time Tx longer. This is because, as the specified time Tx is longer, the aggregation of the colored particles and the adhesion of the colored particles to the inner walls of the capsules at the time of starting the preparatory driving becomes stronger. Therefore, it is possible to enhance the effect of improving the response of the colored particles and reliably improve the response thereof by making the preparatory driving time Ty longer.

In addition, as the specified time Tx changed by the controller 309 is longer, the preparatory driving voltage, which generates a stronger preparatory electric field after the elapse of the changed specified time Tx, may be applied. According to this configuration, the same effect can be obtained.

The electronic paper according to the second embodiment is the image display device that has the display unit 1300 and the driving unit 1200. In the display unit 1300, the colored particles 1014W and 1014B as the electrophoretic particles are provided between the transparent electrode 1006 on the transparent substrate 1301 and the pixel electrodes 1005 as the rear-surface electrodes on the active matrix circuit substrate 1201. The pixel electrodes 1005 and the transparent electrode 1006 are provided for each of the plural display pixels constituting the display image. Furthermore, in the display unit 1300, the driving electric field, which moves the colored particles 1014W and 1014B to the pixel electrodes 1005 or the transparent electrode 1006, is generated between the pixel electrodes 1005 and the transparent electrode 1006 for each of the display pixels. Accordingly, when the colored particles 1014W and 1014B are moved, the display status of each of the display pixels is changed. The driving unit 1200 applies, after receiving the display-switch starting signal as the display driving instruction, the display driving voltage for controlling the driving electric field of each of the display pixels to at least one of the pixel electrodes 1005 and the transparent electrode 1006 for each of the display pixels between the pixel electrodes 1005 and the transparent electrode 1006. In the image display device, even after the driving unit 1200 completes the application of the display driving voltage, the arrangement of the colored particles 1014W and 1014B corresponding to the display driving voltage is maintained, which results in maintaining the display status of the display image. Then, the driving unit 1200 applies, at the predetermined time interval Tz, the preparatory driving voltage for generating the preparatory electric field capable of improving the response of the colored particles 1014W and 1014B to the driving electric field to an extent so as not to change the arrangement of the colored particles 1014W and 1014B between the pixel electrodes 1005 and the transparent electrode 1006 for the predetermined preparatory driving time Ty. Even with this configuration, similar to the case of the first embodiment, the preparatory electric field is caused to act on the colored particles 1014W and 1014B, thereby making it possible for the colored particles 1014W and 1014B to easily move when the driving unit 1200 applies the next display driving voltage. In addition, the preparatory driving voltage is less likely to be applied until the driving unit 1200 applies the display driving voltage after receiving the display-switch starting signal. Accordingly, display switch time until the driving unit 1200 applies the display driving voltage after receiving the display-switch starting signal to complete the display switch of an image can be reduced. As a result, the display switch of the image can be performed at high speed. Particularly, in the second embodiment, it is possible to provide desired response of the colored particles 1014W and 1014B constantly at the time of the display switch by properly setting the specified time Tz.

The electronic paper according to the third embodiment is the image display device that has the display unit 1300 and the driving unit 1200. In the display unit 1300, the colored particles 1014W and 1014B as the electrophoretic particles are provided between the transparent electrode 1006 on the transparent substrate 1301 and the pixel electrodes 1005 that are the rear-surface electrodes on the active matrix circuit substrate 1201 and provided for each of the plural display pixels constituting the display image. Furthermore, in the display unit 1300, the driving electric field, which moves the colored particles 1014W and 1014B to the pixel electrodes 1005 or the transparent electrode 1006, is generated between the pixel electrodes 1005 and the transparent electrode 1006 for each of the display pixels. Accordingly, when the colored particles 1014W and 1014B are moved, the display status of each of the display pixels is changed. The driving unit 1200 applies, after receiving the display-switch starting signal as the display driving instruction, the display driving voltage for controlling the driving electric field of each of the display pixels to at least one of the pixel electrodes 1005 and the transparent electrode 1006 for each of the display pixels between the pixel electrodes 1005 and the transparent electrode 1006. In the image display device, even after the driving unit 1200 completes the application of the display driving voltage, the arrangement of the colored particles 1014W and 1014B corresponding to the display driving voltage is maintained, which results in maintaining the display status of the display image. Then, the driving unit 1200 has the touch sensor 316 as the external information detection unit that detects contact information as to whether the electronic paper is being held by the user and the controller 309 as the use-status determination unit that determines whether the electronic paper is in use based on the detection result by the touch sensor 316. With the timing determined based on the determination result by the controller 309, the driving unit 1200 applies the preparatory driving voltage for generating the preparatory electric field capable of improving the response of the colored particles 1014W and 1014B to the driving electric field to an extent so as not to change the arrangement of the colored particles 1014W and 1014B between the pixel electrodes 1005 and the transparent electrode 1006 for the predetermined preparatory driving time Ty. Even with this configuration, similar to the cases of the first and second embodiments, the preparatory electric field is caused to act on the colored particles 1014W and 1014B, thereby making it possible for the colored particles 1014W and 1014B to easily move when the driving unit 1200 applies the next display driving voltage. In addition, the preparatory driving voltage is less likely to be applied until the driving unit 1200 applies the display driving voltage after receiving the display-switch starting signal. Accordingly, display switch time until the driving unit 1200 applies the display driving voltage after receiving the display-switch starting signal to complete the display switch of an image can be reduced. As a result, the display switch of the image can be performed at high speed. Particularly, according to the third embodiment, it is possible to reduce an accident in which the preparatory driving voltage is applied even when the electronic paper is not being used by the user. As a result, it is possible to minimize the needless application of the preparatory driving voltage.

In the first through third embodiments, the driving unit 1200 applies the preparatory driving voltage for generating the preparatory electric field (alternating electric field) that changes the strength of an electric field during the predetermined preparatory driving time Ty. Accordingly, the response of the colored particles 1014W and 1014B can effectively be improved.

Furthermore, in the electronic paper according to the first through third embodiments, the pixel electrodes 1005 are separately arranged in a matrix form so as to correspond to the display pixels. The driving unit 1200 includes the active matrix circuit having the TFTs 1001 as the active elements for controlling the application of a voltage to the pixel electrodes 1005. In the active matrix circuit, the drain terminals 1004 as the driving output terminals of the TFTs 1001 are connected to the pixel electrodes 1005. When the active-status selection voltage is input to the gate terminals 1002 as the status selection terminals of the TFTs 1001, the driving voltage applied to the source terminals 1003 as the driving input terminals of the TFTs 1001 is applied to the pixel electrodes 1005 through the drain terminals 1004 of the TFTs 1001. Then, when the non-active-status selection voltage is input to the gate terminals 1002 of the TFTs 1001, the driving voltage applied to the source terminals 1003 of the TFTs 1001 is not applied to the pixel electrodes 1005. The driving unit 1200 applies the active-status selection voltage to the gate terminals 1002 of the TFTs 1001 plural times during the predetermined preparatory driving time Ty while applying at least two types of the preparatory driving voltages to the source terminals 1003 of the TFTs 1001 plural times. Accordingly, the preparatory driving voltage can be applied based on the same control operation as that when the display driving voltage is applied. As a result, the configuration of the electronic paper can be simplified.

Furthermore, the preparatory driving voltage specific to each of the display pixels is applied between the pixel electrodes 1005 and the transparent electrode 1006. Therefore, it is possible to apply the preparatory driving voltage suitable for each of the display pixels. As a result, it is possible to stably perform the display switch as a whole at high speed.

Furthermore, in the first through third embodiments, the preparatory driving voltage applied to each of the display pixels is determined in accordance with the display driving voltage previously applied between the pixel electrodes 1005 and the transparent electrode 1006 corresponding to the display pixels. Accordingly, the preparatory driving voltage suitable for the arrangement of the colored particles 1014W and 1014B in each of the display pixels can be applied. As a result, the display switch can stably be performed as a whole at high speed.

Furthermore, in the first through third embodiments, the polarity of the preparatory driving voltage applied to each of the display pixels is biased to the same as that of the display driving voltage previously applied between the pixel electrodes 1005 and the transparent electrode 1006 corresponding to the display pixels. Thus, even if the amount of the preparatory driving voltage is set to be relatively large, the arrangement of the colored particles 1014W and 1014B of the display pixels can stably be maintained. Accordingly, it is possible to effectively improve the response of the colored particles 1014W and 1014B in a shorter preparatory driving time, while maintaining the display status of the display pixels.

Note that the polarity of the preparatory driving voltage applied to each of the display pixels may be biased to be opposite to that of the display driving voltage previously applied between the pixel electrodes 1005 and the transparent electrode 1006 corresponding to the display pixels. In this case, because the effect of reducing the adhesion of the colored particles 1014W and 1014B to the inner walls of the capsules is enhanced, it is possible to effectively improve the response of the colored particles 1014W and 1014B in a shorter preparatory driving time.

Furthermore, in the first through third embodiments, when the driving unit 1200 receives the display-switch starting signal during the predetermined preparatory driving time Ty, it stops the application of the preparatory driving voltage to at least the display pixels in which the arrangement of the colored particles 1014W and 1014B is changed by the driving electric field corresponding to the display driving voltage applied in accordance with the display-switch starting signal, and then starts the application of the display driving voltage corresponding to the display control instruction. Accordingly, the interference of the application of the display driving voltage due to the application of the preparatory driving voltage can be prevented. Even if the driving unit 1200 receives the display-switch starting signal during the application of the preparatory driving voltage, it can perform the display switch at high speed.

Furthermore, as described in the first embodiment, the driving unit 1200 may not perform the preparatory driving in accordance with a predetermined condition. Specifically, the controller 309 functions as the determination unit that determines whether to cause the driving unit 1200 to apply the preparatory driving voltage at the time of applying the preparatory driving voltage in accordance with the predetermined determination condition. In this case, if the controller 309 determines that the preparatory driving voltage is applied, the driving unit 1200 applies the preparatory driving voltage at that time. On the other hand, if the controller 309 determines that the preparatory driving voltage is not applied, the driving unit 1200 does not apply the preparatory driving voltage. Accordingly, the application of the preparatory driving voltage is skipped in accordance with the condition, thereby making it possible to provide effects such as meeting the user's demands or reduction of the consumption of a battery.

The present invention is not limited to the specifically disclosed embodiments, and variations and modifications may be made without departing from the scope of the present invention.

The present application is based on Japanese Priority Application No. 2007-283334 filed on Oct. 31, 2007, the entire contents of which are hereby incorporated herein by reference.

What is claimed is:

1. An image display device comprising:

a display unit that has electrophoretic particles between a rear-surface electrode on a rear-surface substrate and a transparent electrode on a transparent substrate provided for each of plural display pixels constituting a display image and that generates a driving electric field for moving the electrophoretic particles to the rear-surface electrode or the transparent electrode between the rear-surface electrode and the transparent electrode for each of the plural display pixels, a display status of each of the plural display pixels being changed when the electrophoretic particles are moved; and a driving unit that applies, after receiving a display driving instruction, a display driving voltage for controlling the driving electric field of each of the plural display pixels to at least one of the rear-surface electrode and the transparent electrode for each of the plural display pixels, an arrangement of the electrophoretic particles corresponding to the display driving voltage being maintained even after the driving unit completes the application of the display driving voltage, which results in maintaining the display status of the display image, wherein, when not applying a next display driving voltage even after a predetermined time elapses from starting or completion of applying a previous display driving voltage, the driving unit applies, to at least one of the rear-surface electrode and the transparent electrode, a preparatory driving voltage for generating a preparatory electric field capable of improving a response of the electrophoretic particles to the driving electric field to an extent so as not to change the arrangement of the electrophoretic particles for a predetermined preparatory driving time, the predetermined time is adjusted based on whether a power source of the image display is a battery or an electric power supply.

2. The image display device according to claim 1, wherein, when another predetermined time longer than the predetermined time elapses in a state in which the next display driving voltage is not applied from the starting or completion of applying the previous display driving voltage after the application of the preparatory driving voltage, the driving unit applies another preparatory driving voltage the same as or different from the preparatory driving voltage.

3. The image display device according to claim 1, wherein the driving unit has:

a counting unit that counts an elapsed time from the starting or completion of applying the previous display driving voltage; and a determination unit that determines whether the elapsed time counted by the counting unit exceeds the predetermined time without the application of the next display driving voltage; wherein the driving unit starts the application of the preparatory driving voltage when the determination unit determines that the elapsed time exceeds the predetermined time.

4. The image display device according to claim 1, further comprising:

a change unit that changes the predetermined time in accordance with a predetermined change condition.

5. The image display device according to claim 4, wherein, if the predetermined time changed by the change unit is longer, the driving unit makes the predetermined preparatory driving time after the elapse of the changed predetermined time longer.

6. The image display device according to claim 4, wherein, if the predetermined time changed by the change unit is longer, the driving unit applies the preparatory driving voltage that generates a stronger preparatory electric field after the elapse of the changed predetermined time.

7. An image display device comprising:

a display unit that has electrophoretic particles between a rear-surface electrode on a rear-surface substrate and a transparent electrode on a transparent substrate provided for each of plural display pixels constituting a display image and that generates a driving electric field for moving the electrophoretic particles to the rear-surface electrode or the transparent electrode between the rear-surface electrode and the transparent electrode for each of the plural display pixels, a display status of each of the plural display pixels being changed when the electrophoretic particles are moved; and a driving unit that applies, after receiving a display driving instruction, a display driving voltage for controlling the driving electric field of each of the plural display pixels to at least one of the rear-surface electrode and the transparent electrode for each of the plural display pixels, an arrangement of the electrophoretic particles corresponding to the display driving voltage being maintained even after the driving unit completes the application of the display driving voltage, which results in maintaining the display status of the display image, wherein the driving unit applies, to at least one of the rear-surface electrode and the transparent electrode at a predetermined time interval, a preparatory driving voltage for generating a preparatory electric field capable of improving a response of the electrophoretic particles to the driving electric field to an extent so as not to change the arrangement of the electrophoretic particles for a predetermined preparatory driving time, the predetermined time is adjusted based on whether a power source of the image display is a battery or an electric power supply.

8. An image display device comprising:

a display unit that has electrophoretic particles between a rear-surface electrode on a rear-surface substrate and a transparent electrode on a transparent substrate provided for each of plural display pixels constituting a display image and that generates a driving electric field for moving the electrophoretic particles to the rear-surface electrode or the transparent electrode between the rear-surface electrode and the transparent electrode for each of the plural display pixels, a display status of each of the plural display pixels being changed when the electrophoretic particles are moved; and a driving unit that applies, after receiving a display driving instruction, a display driving voltage for controlling the driving electric field of each of the plural display pixels to at least one of the rear-surface electrode and the transparent electrode for each of the plural display pixels, an arrangement of the electrophoretic particles corresponding to the display driving voltage being maintained even after the driving unit completes the application of the display driving voltage, which results in maintaining the display status of the display image, wherein the driving unit has an external information detection unit that detects external information as to whether the image display device is being used by a user and a use-status determination unit that determines whether the image display device is in use based on a detection result by the external information detection unit, the external information detection unit further detecting whether a power source of the image display device is a battery or an electric power supply and wherein the driving unit applies, to at least one of the rear-surface electrode and the transparent electrode with timing determined based on the determination result by the use-status determination unit, a preparatory driving voltage for generating a preparatory electric field capable of improving a response of the electrophoretic particles to the driving electric field to an extent so as not to change the arrangement of the electrophoretic particles for a predetermined preparatory driving time.

9. The image display device according to claim 1, wherein the driving unit applies the preparatory driving voltage for generating the preparatory electric field that changes a strength of an electric field during the predetermined preparatory driving time.

10. The image display device according to claim 9, wherein at least one of the rear-surface electrode and the transparent electrode is separately arranged in a matrix form so as to correspond to each of the display pixels, the driving unit includes an active matrix circuit having an active element for controlling the application of a voltage to at least one of the rear-surface electrode and the transparent electrode, the active matrix circuit has a driving output terminal of the active element connected to at least one of the rear-surface electrode and the transparent electrode and operates so that the driving voltage applied to a driving input terminal of the active element is applied to at least one of the rear-surface electrode and the transparent electrode through the driving output terminal of the active element when an active-status selection voltage is input to a status selection terminal of the active element and operates so that the driving voltage applied to the driving input terminal of the active element is not applied to at least one of the rear-surface electrode and the transparent electrode when a non-active-status selection voltage is input to the status selection terminal of the active element, and the driving unit applies the active-status selection voltage to the status selection terminal of the active element plural times during the predetermined preparatory driving time while applying at least two types of the preparatory driving voltages to the driving input terminal of the active element plural times.

11. The image display device according to claim 1, wherein the driving unit applies the preparatory driving voltage specific to each of the display pixels to at least one of the rear-surface electrode and the transparent electrode.

12. The image display device according to claim 11, wherein the preparatory driving voltage applied to each of the display pixels is determined in accordance with the display driving voltage previously applied to the display pixels.

13. The image display device according to claim 12, wherein a polarity of the preparatory driving voltage applied to each of the display pixels is biased to the same as the polarity of the display driving voltage previously applied to the display pixels.

14. The image display device according to claim 12, wherein a polarity of the preparatory driving voltage applied to each of the display pixels is biased to be opposite to the polarity of the display driving voltage previously applied to the display pixels.

15. The image display device according to claim 1, wherein, when receiving the display driving instruction during the predetermined preparatory driving time, the driving unit stops the application of the preparatory driving voltage to at least the display pixels in which the arrangement of the electrophoretic particles is changed by the driving electric field corresponding to the display driving voltage applied in accordance with the display driving instruction, and then starts the application of the display driving voltage corresponding to the display control instruction.

16. The image display device according to claim 1, wherein the driving unit has a determination unit that determines whether to cause the driving unit to apply the preparatory driving voltage at a time of applying the preparatory driving voltage in accordance with a predetermined determination condition, and the driving unit applies the preparatory driving voltage at the time of applying the preparatory driving voltage if the determination unit determines that the preparatory driving voltage is applied, and the driving unit does not apply the preparatory driving voltage at the time of applying the preparatory driving voltage if the determination unit determines that the preparatory driving voltage is not applied.

* * * * *